US005882210A

United States Patent [19]

Embo et al.

[11] Patent Number: 5,882,210

[45] Date of Patent: Mar. 16, 1999

[54] DEVICE FOR CONNECTING A COAXIAL CONNECTOR TO A PRINTED CIRCUIT BOARD BY SURFACE MOUNTING

[75] Inventors: Georges Embo, Langemark; Peter Baertsoen, Zulte, both of Belgium

[73] Assignee: Siemens Aktiengesellschaft, Munich, Germany

[21] Appl. No.: 52,343

[22] Filed: Mar. 30, 1998

Related U.S. Application Data

[63] Continuation of PCT/DE96/01722 Sep. 13, 1996.

[30] Foreign Application Priority Data

Sep. 28, 1995 [DE] Germany ..... 195 36 276.4

[51] Int. Cl.[6] ..... H01R 9/09

[52] U.S. Cl. ..... 439/63; 439/581

[58] Field of Search ..... 439/63, 581, 83

[56] References Cited

U.S. PATENT DOCUMENTS 5,078,621 1/1992 Nishikawa et al. ..... 439/581
5,215,470 6/1993 Henry et al. ..... 439/63
5,482,477 1/1996 Michael ..... 439/63
5,711,676 1/1998 Michael, III ..... 439/63

FOREIGN PATENT DOCUMENTS

0545289A1 6/1993 European Pat. Off. .
0624928A1 11/1994 European Pat. Off. .

*Primary Examiner*—Steven L. Stephan
*Assistant Examiner*—T. C. Patel
*Attorney, Agent, or Firm*—Herbert L. Lerner; Laurence A. Greenberg

[57] ABSTRACT

The cuboid housing of the printed circuit board coupler is made from conducting material and it can be soldered directly to the printed circuit board. An inner conductor connection member is inserted into and insulated from the housing. The insulation is provided by a plastics part which is partially extrusion-coated on the inner conductor connection member at a region where connecting elements angle off from a plug-in element. The printed circuit board coupler can thus be soldered with the housing itself and with bends of the inner conductor connection member in a horizontal or vertical position on the printed circuit board by surface mounting.

12 Claims, 4 Drawing Sheets

DEVICE FOR CONNECTING A COAXIAL CONNECTOR TO A PRINTED CIRCUIT BOARD BY SURFACE MOUNTING

CROSS-REFERENCE TO RELATED APPLICATION

This application is a continuation of copending international application Ser. No. PCT/DE96/01722, filed Sep. 13, 1996, which designated the United States.

BACKGROUND OF THE INVENTION

Field of the Invention

The invention relates to a device for connecting a coaxial connector to a printed circuit board with a surface mount (SM) technique. The device generally comprises a cuboid housing with an outer conductor connection and an inner conductor connection member, the outer conductor connection and the inner conductor connection member being constructed in the connection region on the printed circuit board such that the SM connection can be carried out on the printed circuit board in a first, lying position of the housing or in a second, standing position, which is rotated by 90° relative to the first position.

Such a device is commercially available under the general designation of printed circuit board coupler of the MMCX series. The coupler is configured in a miniature design such that it can be connected on a printed circuit board by surface mounting. For that purpose, the prior art printed circuit board coupler has a cuboid housing of plastic with an outer conductor connection and inner conductor connection. Each of the connections are guided to the outside and configured in the respective connection region such that the coupler can be SM soldered on the printed circuit board horizontally or vertically. A surface-treated sleeve in the form of a rotary part made from a conducting material is provided as the outer conductor connection. The outer conductor connection further includes a connecting part which is punched from strip material, pre-bent and connected reliably mechanically and electrically to the sleeve. The inner conductor connection is punched from a metal strip, at least partly surface-treated, for example galvanized in the connection region and gilded in the plug-in region, and pre-bent. In order to produce the printed circuit board coupler, the outer conductor sleeve preassembled with the connecting part is laid together with the inner conductor connection in an injection mold and extrusion-coated with a heat-resistant plastic. This operation requires processing steps which are quite problematic and relatively expensive. Finally, the outwardly projecting connection regions of the pre-bent outer conductor connection and inner conductor connection are bent to finish so as to produce at mutually perpendicular outer sides of the cuboid housing connection regions which serve both for the outer conductor connection and for the inner conductor connection as solder surfaces and which permit the coupler to be SM soldered horizontally or vertically.

SUMMARY OF THE INVENTION

It is accordingly an object of the invention to provide a device for connecting a coaxial connector to a printed circuit board by surface mounting, which overcomes the above-mentioned disadvantages of the prior art devices and methods of this general type and which is simplified in its production and also in its structural design.

With the foregoing and other objects in view there is provided, in accordance with the invention, a device for connecting a coaxial connector to a printed circuit board by surface mounting, comprising:

a cuboid housing formed of an electrically conducting material and having a solderable surface on two mutually orthogonal outer surfaces adapted to directly connect the cuboid housing to a printed circuit board by surface mount soldering;

an outer conductor connection and an inner conductor connection member rigidly supported in the cuboid housing, the outer conductor connection and the inner conductor connection member being constructed such that respective terminals thereof may be surface mount soldered to the printed circuit board selectively in a first, lying position of the housing or in a second, standing position rotated by 90° relative to the first position; and an insulating part carrying the inner conductor connection member, the insulating part being insertible from outside into the cuboid housing and fixing and insulating the inner conductor connection member in the cuboid housing.

The objects of the invention are attained by virtue of the fact that the housing consists of a conducting material and it has a solderable surface at least on two mutually orthogonal outer surfaces of the cuboid structure. The housing itself can thus be connected to the printed circuit board by SM soldering. The inner conductor connection member is partially constructed with an insulating part which can be inserted from outside into the housing such that the inner conductor connection member is fixed in and insulated from the housing.

Essential features of such a device are that the cuboid housing consists of conducting material and can itself be connected on the printed circuit board by SM soldering, and that the inner conductor connection member is inserted in a simple way, for example by being plugged in, into this cuboid housing. Such a device can therefore be produced in a simpler and more economic way without processing steps which are problematical. Moreover, an improved functional design results with regard to RF tightness, since the outer conductor of the coaxial connector is a metal housing. A cuboid housing can be produced, for example, by lathe rotation starting from a square profile material, made from brass. The brass body may be surface treated in different ways.

In accordance with an added feature of the invention, the housing includes a first outer surface having a first opening formed therein for the outer conductor connection, and a second outer surface parallel to and opposite from the first outer surface, the second outer surface having a second opening formed therein for the inner conductor connection member, the second opening being coaxially aligned with the first opening.

In accordance with an additional feature of the invention, a surface-treated outer conductor sleeve formed of conducting material is inserted into the first opening of the housing. This is particularly advantageous with regard to surface treatment processing of the cuboid housing. In this way, a special sealing operation for the first opening can be dispensed with which would otherwise be required because of the different surface treatment on the inside and outside of the housing.

The inner conductor connection member is configured in a simple way in a device according to the invention such that the inner conductor connection member has a plug-in element and a connecting element angled off by 90° relative thereto, and is partially provided with the insulating part in the mutually neighboring region at the angling-off of the plug-in element and connecting element. It is advantageous in this case with regard to a simple insertion of the inner conductor connection member into the housing if the insulating part forms a stopper which can be plugged into the second opening of the housing.

In accordance with an additional feature of the invention, the insulating part of the inner conductor connection member is formed with a depression on a side of the plug-in element.

In accordance with another feature of the invention, the plug-in element is formed of two surface-finished contact tongues and the connecting element is constructed in a shape of a walking stick with two 90° bends.

In accordance with again an added feature of the invention, the housing has a cutout formed therein on a cube edge and two adjacent housing surfaces, the cutout receiving a connecting element of the inner conductor connection member projecting from the insulating part. This leads to a very compact configuration and to a favorable outer contour of the housing.

In accordance with again an additional feature of the invention, the two 90° bends of the connecting element of the inner conductor connection member each have an outer surface flush with a respective outer surface of the cuboid housing.

In accordance with again a further feature of the invention, the cutout is formed with a boundary face parallel to the second outer surface of the housing, the insulating part inserted into the housing being spaced apart from the boundary face of the cutout.

In accordance with again another feature of the invention, the insulating part inserted into the opening is set back inwardly with respect to the outer surface of the housing.

In accordance with a concomitant feature of the invention, the insulating part of the inner conductor connection member has a peripheral surface formed with a projecting longitudinal rib, and the opening is formed with a complementary longitudinal groove for receiving the rib. The inner conductor connection member is thus advantageously secured against rotation in the housing.

Other features which are considered as characteristic for the invention are set forth in the appended claims.

Although the invention is illustrated and described herein as embodied in a device for connecting a coaxial connector to a printed circuit board by surface mounting, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
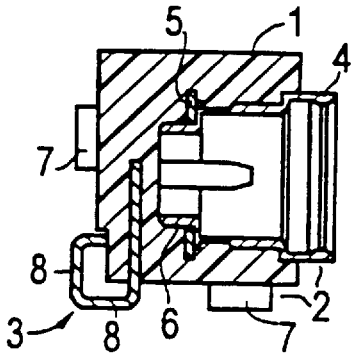
FIG 1 PRIOR ART
FIG. 1 is a sectional view taken along the line I—I of FIG. 3 of a prior art device.
Figure 2:
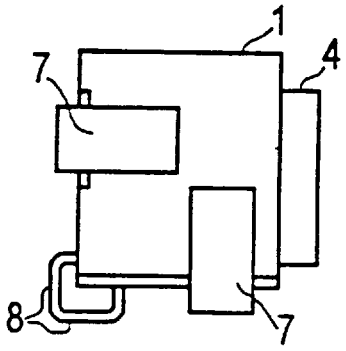
FIG 2 PRIOR ART
FIGS. 2 to 4 are various elevational views of the prior art device.
Figure 3:
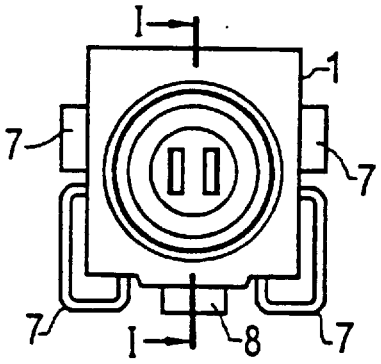
FIG 3 PRIOR ART
Figure 4:
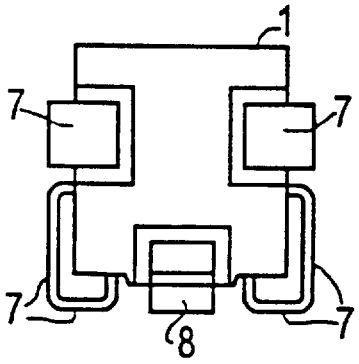
FIG 4 PRIOR ART

Referring now to the figures of the drawing in detail and first, particularly, to FIGS. 1 to 4 thereof, there is seen a device which is known as a printed circuit board coupler. The coupler comprises a cuboid plastics housing 1 with an outer conductor connection 2 and an inner conductor connection 3. An outer conductor is formed with a sleeve 4, which is produced from a rotary part, galvanized and gilded, and a connecting part 5, which is punched from galvanized strip material and pre-bent. The connecting part 5 has a central bore and it is pressed onto a matching mandrel 6 of the sleeve 4 in order to achieve a mechanically and electrically reliable connection. The inner conductor connecting part 3 is punched from a metal strip, pre-bent and subsequently galvanized in the connection region and gilded in the plug-in region. In order to produce the printed circuit board coupler, the sleeve 4 preassembled with the connecting part 5 is laid together with the inner conductor connecting part 3 in an injection mold and extrusion-coated with a heat-resistant plastic. This forms a cuboid housing 1. Finally, the outwardly projecting connection regions of the pre-bent outer conductor connecting part 5, as well as the outwardly projecting connection regions of the pre-bent inner conductor connecting part 3, are bent to finish so as to form on different, mutually perpendicular cube sides outer conductor terminals 7 and inner terminals 8. The terminals 7 and 8 are thus disposed on an exterior of the cube such that, with the aid of the terminals 7 and 8, the printed circuit board coupler can be soldered on a printed circuit board either horizontally or vertically with an SM process.

Referring now to FIGS. 5 to 12, the housing 10 of the novel printed circuit board coupler consists of conducting material. The housing 10 is produced by lathe rotation starting from a square profile material, preferably made from brass. In other words, the housing already has a cuboid shape defined by its raw block material. Working of the raw block by rotating may be initiated on a first outer surface 11. The surface 11 is directed perpendicular to the later connecting and longitudinal direction of a coaxial cable. A first opening 12 for the outer conductor connection, for example for a screw terminal of the coaxial cable, is first formed in the surface 11. A second opening 14, coaxial with the first opening 12, is formed in a surface 13 which is parallel to the surface 11. The second opening 14 is provided for an inner conductor connection member 15.

The openings 12 and 14, which are best visible in the sectional views of FIGS. 7, 9, 11 and 12, are multiply stepped in diameter for the purpose of connecting the outer conductor connection or of accommodating the inner conductor connection member 15. The housing 10 is completely surface treated by means of a barrel method. In this case, for reasons of contact security a finished surface is provided on the inside, and a surface which can be soldered by means of reflow soldering is provided on the outside at least on two mutually perpendicular outer sides of the cuboid housing 10. In this galvanization operation with a nickel surface which is finished on the inside, for example silver coated or gilded, and a surface which is galvanized on the outside, a removable seal of the two openings 12 and 14 is provided.

Figure 5:
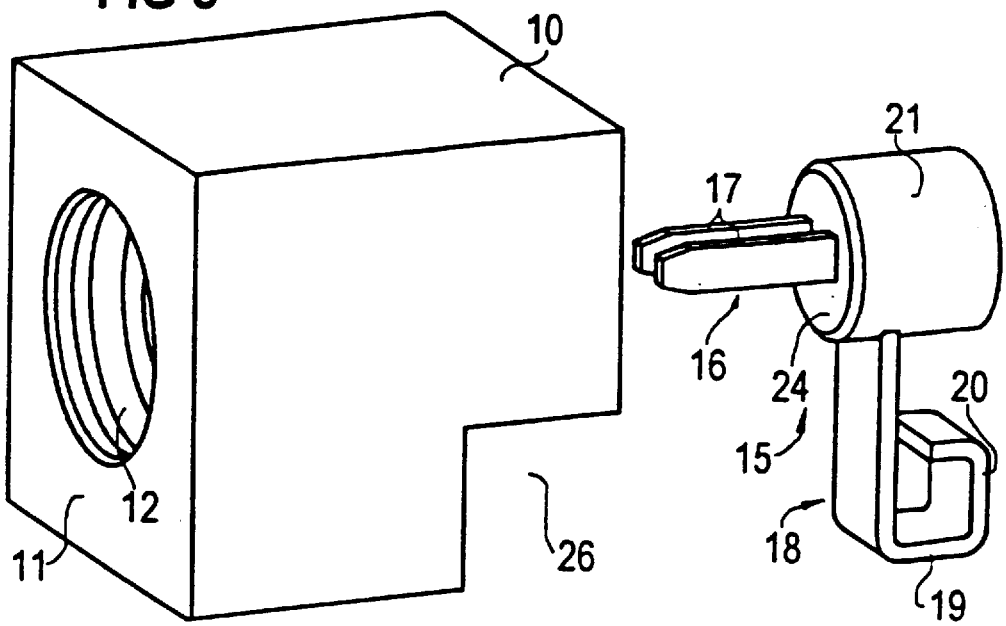
FIGS. 5 and 6 are perspective views of the device according to the invention with a separated inner conductor connection member.
Figure 6:
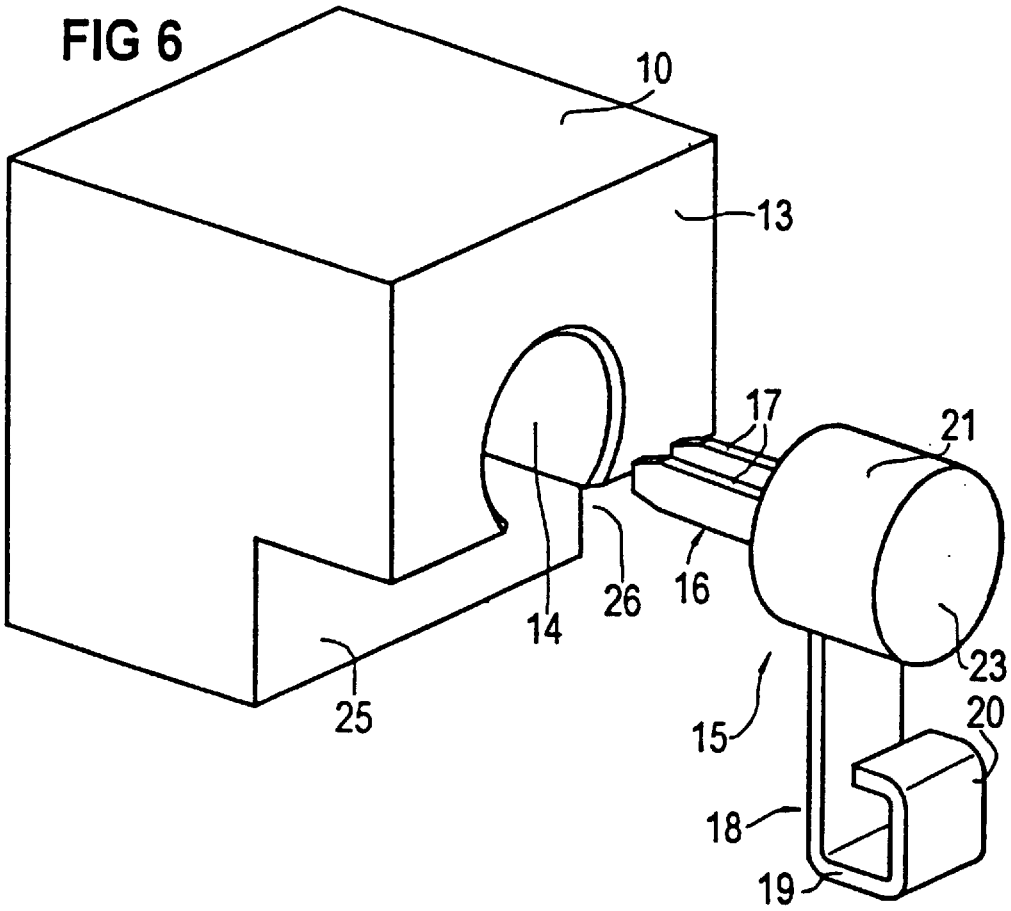
Figure 7:
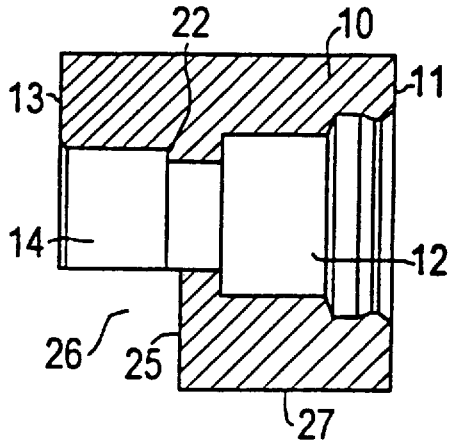
FIG. 7 is a sectional view of the housing of the device.

With specific reference to FIGS. 5 and 6, the inner conductor connection member 15 comprises a plug-in element 16 with two surface-finished contact tongues 17 and a terminal element 18 which is angled off by 90° relative thereto. The terminal element 18 is formed like a walking stick with at least two 90° bends 19 and 20. The inner conductor connection member 15 is punched from a metal strip, bent to finish with the bends 19 and 20, galvanized in the connection region, gilded in the plug-in region and partly extrusion-coated with a plastics insulating part 21. The insulation is specifically provided in mutually neighboring regions at the angled portion connecting the plug-in element 16 and the terminal element 18. As FIGS. 5 and 6 show, this insulating part 21 has a round bolt shape with an outside diameter which is matched to the inside diameter of the second opening 14 in such a way that it forms a plug stopper which can be pressed into the second opening. When the part 21 is pressed in the second opening 14 of the housing 10, then the insulating part 21 abuts a diameter step 22 between the two openings 12 and 14 (see FIGS. 9, 11, 12). In that regard, the plug 21 is set back somewhat with its outer end face 23 with respect to the second outer surface 13 of the housing 10. In the embodiments according to FIGS. 9 and 12, it is spaced, with its inner end face 24, from the opposite surface of the housing 10, which forms a boundary face 25 of a cutout 26.

As shown clearly throughout FIGS. 5 to 12, the cutout 26 is formed on a cube edge and two adjacent housing sides 13 and 27, and is provided for accommodating, inwardly offset relative to the backwall 13, the connecting element 18, which projects from the insulating part 21, of the inner conductor connection member 15. When the inner conductor connection member 15 according to FIGS. 9 to 12 is inserted into the housing 10, the two 90° bends 19 and 20 of the connecting element 18 of the inner conductor connection member 15 align with their outer surface respectively flush with the outer surface 13 or 27 of the housing 10. The finally assembled printed circuit board coupler in accordance with FIGS. 9 to 12 is thus constructed such that it can be soldered with its housing 10 and with the bends 19 and 20 of the inner conductor connection member 15 either in a horizontal or in a vertical position on a printed circuit board by conventional surface mounting (SMT).

Figure 8:
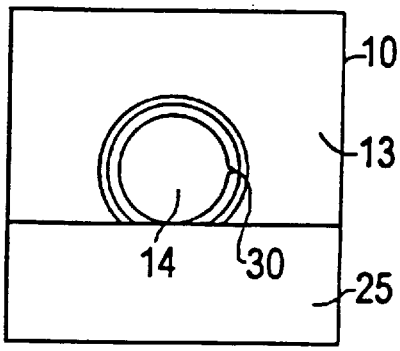
FIG. 8 is a rear elevational view thereof.
Figure 9:
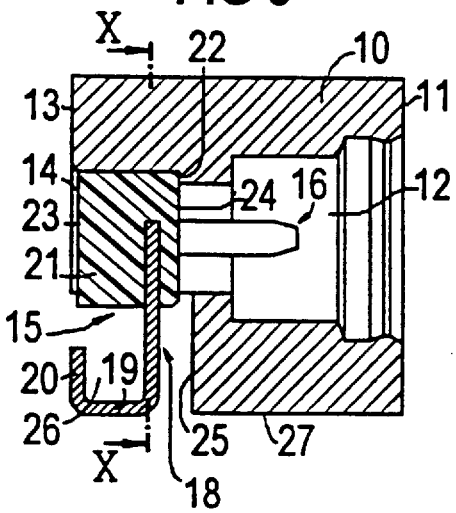
FIG. 9 is a sectional view taken through a first exemplary embodiment of the complete device in an assembled state.
Figure 10:
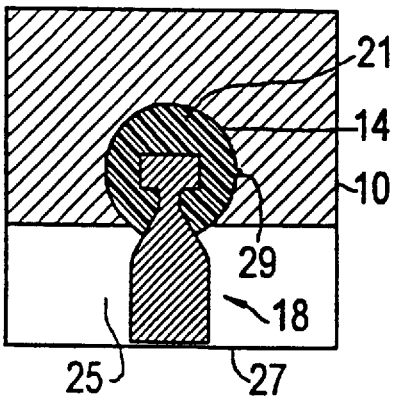
FIG. 10 is a sectional view taken along the line X—X in FIG. 9.
Figure 11:
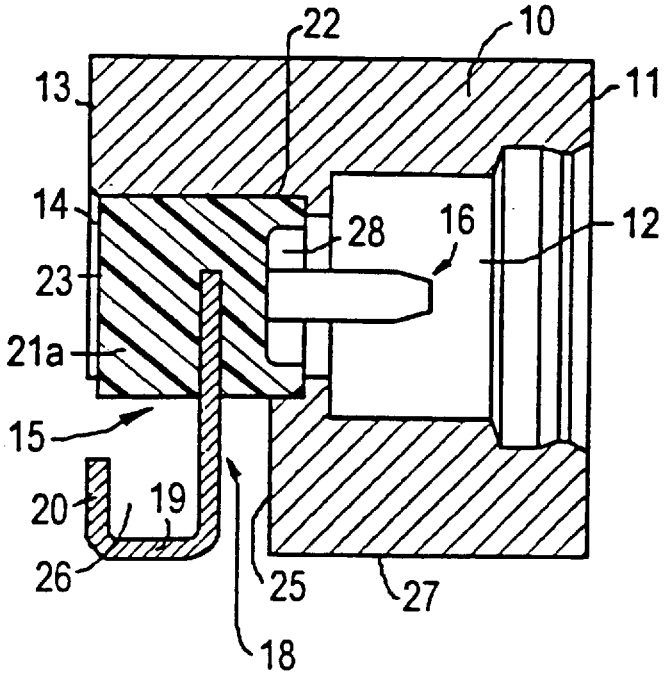
FIGS. 11 and 12 are sectional views, similar to FIG. 9, of two modified exemplary embodiments of the invention.

With specific reference to FIG. 11, the exemplary embodiment illustrated therein differs from the other exemplary embodiments in that the insulating part 21*a* of the inner conductor connection member 15 is plugged on the plug side into the diameter step 22 between the two openings 12 and 14. Accordingly, it is not spaced, on the plug side, from the boundary face 25. The insulating part 21*a* therefore has an extent in the longitudinal direction of the opening 12 which is greater by comparison with the insulating part 21, leads to an improved insulation of the inner conductor and produces extended guidance and superior interference fit. Moreover, the insulating part 21*a* of the inner conductor connection member 15 is further provided with a depression 28 on the side of the plug-in element 16. As shown in FIGS. 8 and 10, in all the exemplary embodiments the insulating part 21 of the inner conductor connection member 15 is constructed on the outside circumference with a projecting longitudinal rib 29 which can be pushed into a longitudinal groove 30 in the second opening 14 of the housing 10.

Figure 12:
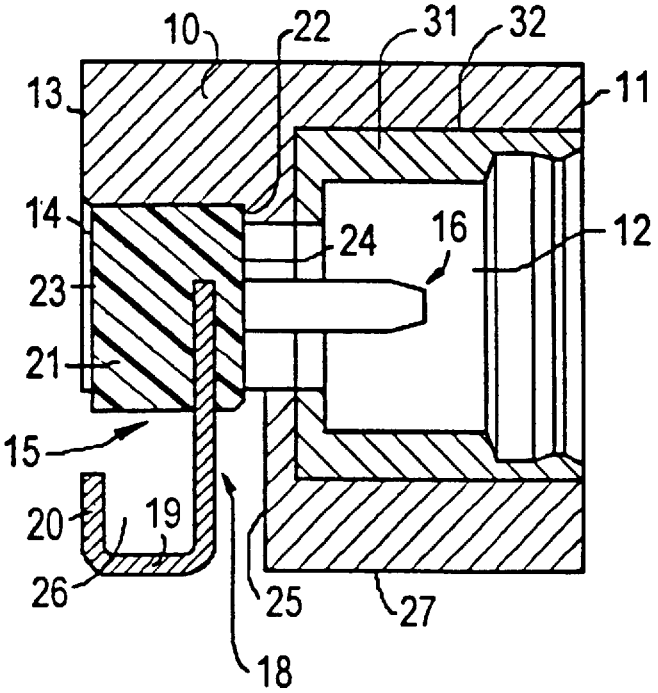

During the above-noted surface treatment of the housing 10, it is possible to avoid having to seal the housing with a removable element, for example a plastics stopper: the device may instead be provided with an element 31 (FIG. 12). The element 31 is a surface-finished outer conductor sleeve 31 consisting of conducting material and inserted, for example by pressing, into the completely galvanized housing. The outer conductor sleeve 31 is inserted at the first outer side 11 of the housing 10 into a bore 32 and, for the purpose of connecting a coaxial cable, has the same inside contour as the first opening 12 in the remaining exemplary embodiments.

We claim:

1. A device for connecting a coaxial connector to a printed circuit board by surface mounting, comprising:

a cuboid housing formed of an electrically conducting material and having a solderable surface on two mutually orthogonal outer surfaces adapted to directly connect said cuboid housing to a printed circuit board by surface mount soldering;

an outer conductor connection and an inner conductor connection member rigidly supported in said cuboid housing, said outer conductor connection and said inner conductor connection member being constructed such that respective terminals thereof may be surface mount soldered to the printed circuit board selectively in a first, lying position of the housing or in a second, standing position rotated by 90° relative to the first position; and an insulating part carrying said inner conductor connection member, said insulating part being insertible from outside into said cuboid housing and fixing and insulating said inner conductor connection member in said cuboid housing.

2. The device according to claim 1, wherein said housing includes a first outer surface having a first opening formed therein for said outer conductor connection, and a second outer surface parallel to and opposite from said first outer surface, said second outer surface having a second opening formed therein for said inner conductor connection member, said second opening being coaxially aligned with said first opening.

3. The device according to claim 2, which further comprises a surface-treated outer conductor sleeve formed of conducting material inserted into said first opening of said housing.

4. The device according to claim 1, wherein said inner conductor connection member is comprised of a plug-in element and a connecting element angled off by 90° relative to said plug-in element, and said insulating part enclosing a region of said inner conductor connection member where said connecting element angles off from said plug-in element.

5. The device according to claim 4, wherein said housing includes an outer surface having an opening formed therein for said inner conductor connection member, said insulating part of said inner conductor connection member being a stopper plug adapted to be pressed into said opening of said housing.

6. The device according to claim 4, wherein said insulating part of said inner conductor connection member is formed with a depression on a side of said plug-in element.

7. The device according to claim 4, wherein said plug-in element is formed of two surface-finished contact tongues and said connecting element is constructed in a shape of a walking stick with two 90° bends.

8. The device according to claim 1, wherein said housing has a cutout formed therein on a cube edge and two adjacent housing surfaces, said cutout receiving a connecting element of said inner conductor connection member projecting from said insulating part.

9. The device according to claim 7, wherein said two 90° bends of said connecting element of said inner conductor connection member each have an outer surface flush with a respective outer surface of said cuboid housing.

10. The device according to claim 8, wherein said cutout is formed with a boundary face parallel to said second outer surface of said housing, said insulating part inserted into said housing being spaced apart from the boundary face of said cutout.

11. The device according to claim 1, wherein said housing includes an outer surface having an opening formed therein for receiving said insulating part of said inner conductor connection member, said insulating part inserted into said opening being set back inwardly with respect to said outer surface of said housing.

12. The device according to claim 1, wherein said housing includes an outer surface having an opening formed therein for receiving said insulating part of said inner conductor connection member, said insulating part of the inner conductor connection member having a peripheral surface formed with a projecting longitudinal rib, and said opening being formed with a complementary longitudinal groove for receiving said rib.

* * * * *